US005094569A

United States Patent [19]

Fleming

[11] Patent Number: 5,094,569

[45] Date of Patent: Mar. 10, 1992

[54] GROUND SURFACE CONTOUR MODIFYING APPARATUS AND METHOD

[76] Inventor: David Fleming, 3369 Dehesa Rd., El Cajon, Calif. 92019

[21] Appl. No.: 621,304

[22] Filed: Nov. 30, 1990

[51] Int. Cl.[5] ..... E02D 27/32; E02D 35/00

[52] U.S. Cl. ..... 405/258; 273/176 H; 273/DIG. 31; 405/36; 405/229

[58] Field of Search ..... 405/36, 38, 229, 230, 405/258, 289; 52/125.1, 126.1, 167 R, 742; 273/32 R, 176 H, DIG. 31

[56] References Cited

U.S. PATENT DOCUMENTS

| | | | |
|---|---|---|---|
| 1,969,324 | 8/1934 | Poulter | 405/230 X |
| 3,040,411 | 6/1962 | Messenger | 405/229 |
| 3,343,369 | 9/1967 | Polhamus | 405/258 |
| 3,455,538 | 7/1969 | Vranian | 405/229 X |
| 3,795,180 | 3/1974 | Larsen | 405/36 |
| 3,908,385 | 9/1975 | Daniel et al. | 405/38 X |
| 4,191,496 | 3/1980 | Becker | 405/229 |
| 4,978,127 | 12/1990 | Juel | 273/176 H |

*Primary Examiner*—David H. Crobin
*Attorney, Agent, or Firm*—Baker, Maxham, Jester & Meador

[57] ABSTRACT

A ground surface contour modifying apparatus and method which includes a plurality of independent, selectively actuable hydraulic elements positioned below the surface of a defined area of ground. Selective actuation of the hydraulic elements enables modification of the contours of the overlying ground surface.

39 Claims, 3 Drawing Sheets

GROUND SURFACE CONTOUR MODIFYING APPARATUS AND METHOD

FIELD OF THE INVENTION

This invention relates generally to landscaping, and more particularly to the landscaping of a game playing surface such as a putting green, and still more particularly, the surface preparation and modification of the shape and contour of a putting green to vary the game playing surface.

BACKGROUND OF THE INVENTION

The putting greens of most golf courses are designed to provide an interesting variety of playing surfaces having varying degrees of difficulty according to the size, contour, grade and texture thereof. In most golf courses, putting greens once designed remain in their original configuration for relatively long durations. The only playing variations result from changing hole locations on a green. Despite the changes engendered by hole location changes, players who repeatedly play on the same course eventually become familiar with the contours of each putting green, which, advantageously, may enable them to lower their scores. However, while a lower score may prove initially satisfying, the boredom associated with playing in a known environment may decrease the player's interest in the course, causing the player to look to other, possibly competing courses. Moreover, a static course would not be desirable for tournament play where course variations are desirable. Moreover, in such situations a guest would be at a disadvantage when playing against an experienced member at his home course.

In an effort to spark renewed interest in the course, to improve or modify tournament play, and to prevent or reduce possible unfair advantage, course owners or superintendents from time to time relandscape the putting greens to provide new contours and grades, thereby modified playing conditions. Such modifications, however, represent a fairly major landscaping task and may entail many hours of labor during which the putting green cannot be used. Accordingly, there is an evident need for a method and apparatus for readily and significantly varying the surface contour and grade of a putting green surface as desired to adapt the golf course to player needs. Such an apparatus would be particularly useful for tournament play where it may be desirable to vary the putting green surfaces for each tournament, or perhaps even between each round so that no players have an advantage based on knowledge of the greens.

SUMMARY OF THE INVENTION

The present invention is directed to a ground surface contour modifying apparatus and method which enables rapid and selective variation of the contour and grade of a ground surface such as a putting green in a plurality of configurations. To that end, multiple independent, selectively actuable contour adjusting means may be provided to selectively raise and lower one or more portions of a ground surface. Preferably these means may be controlled from an independent control point to instantaneously adjust ground surface contour. Additional support structure, filter and drainage means may also be used to provide a self-contained adjustable contour ground surface area.

While the invention is described in conjunction with a golf green, it can be used for changing any ground surface contours, for example, the mound of a baseball diamond, or it could be used to crown any ground surface to improve drainage.

BRIEF DESCRIPTION OF THE DRAWING

The objects, advantages and features of the invention will be more readily perceived from the following detailed description, when read in conjunction with the accompanying drawing, in which.

DESCRIPTION OF THE PREFERRED EMBODIMENTS

Figure 1:
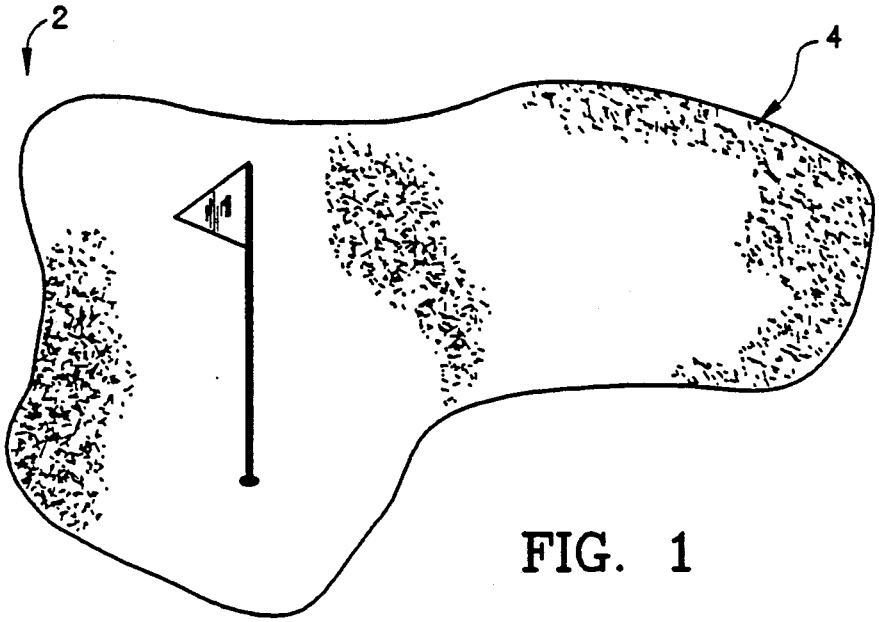
FIG. 1 is a diagrammatic view of a defined area of ground within which an apparatus constructed in accordance with the present invention may be incorporated.
Figure 2:
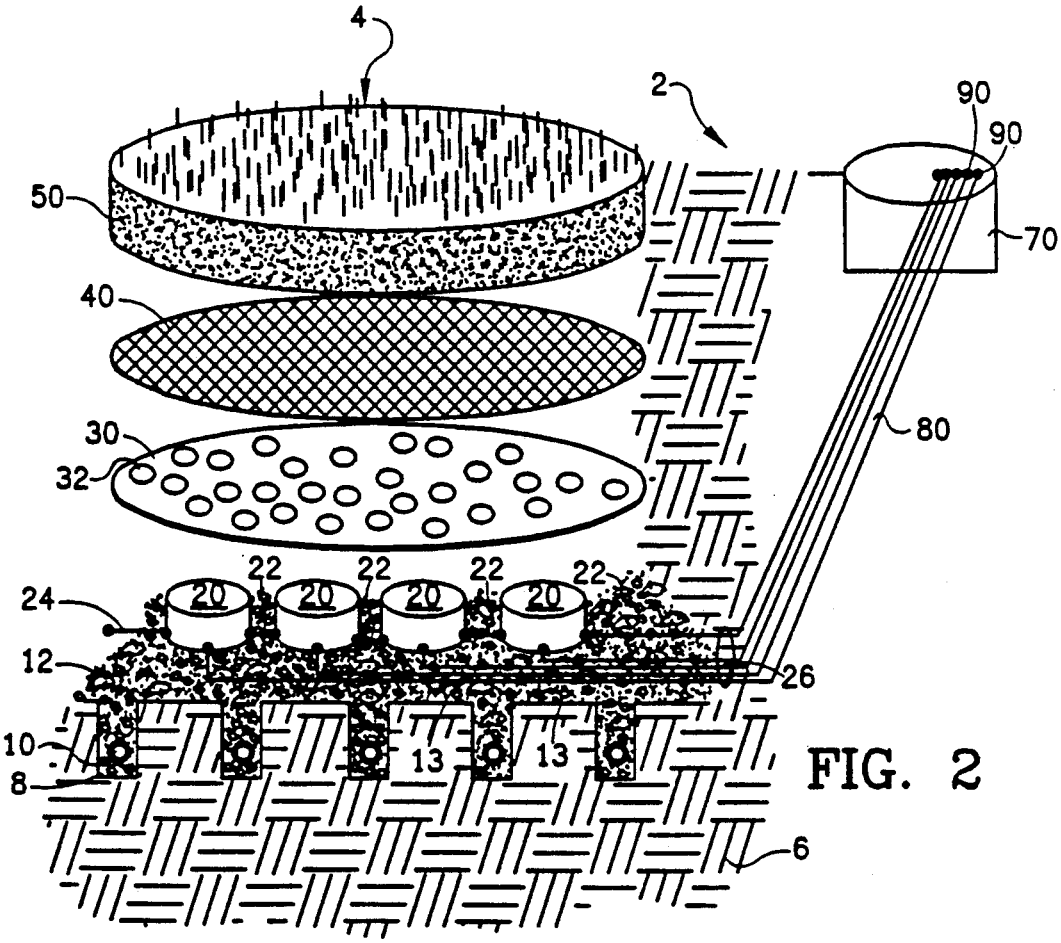
FIG. 2 is a partially exploded perspective view of a ground surface contour modifying apparatus constructed in accordance with the invention wherein the apparatus is in a first actuated state within a defined area of ground.

Referring now to FIGS. 1 and 2, a ground surface contour modifying apparatus is installed in an area of surrounding landscape 2. A defined area of ground 4 within the surrounding landscape area 2 houses the ground surface contouring modifying apparatus. The defined area of ground 4 and means for changing the surface contour thereof are formed by preparing a defined area 6 of compacted subsoil below the surface of landscape area 2. A plurality of drainage wells 8 are formed within compacted subsoil area 6. Within each drainage well 8 is positioned drainage tile pipe 10 which is conventionally directed to a remote drainage area. Each drainage well 8 is then packed with gravel or drainage rock and an additional layer of ground to form gravel bed 12 above surfaces 13 of compacted subsoil area 6, in order to further facilitate drainage. The thickness of drainage bed 12 above surface 13 may typically be about four inches, for example. Upon gravel bed 12 are placed a plurality of hydraulic elements 20, an example of which would be inflatable cylinders made from flexible, non-corrosive bladders. The hydraulic elements 20 could also be formed by a stainless steel cylinder and piston arrangement. Other adjustable lifting apparatus would also no doubt be possible. The hydraulic elements are preferably independent of one another and selectively actuable.

Figure 3:
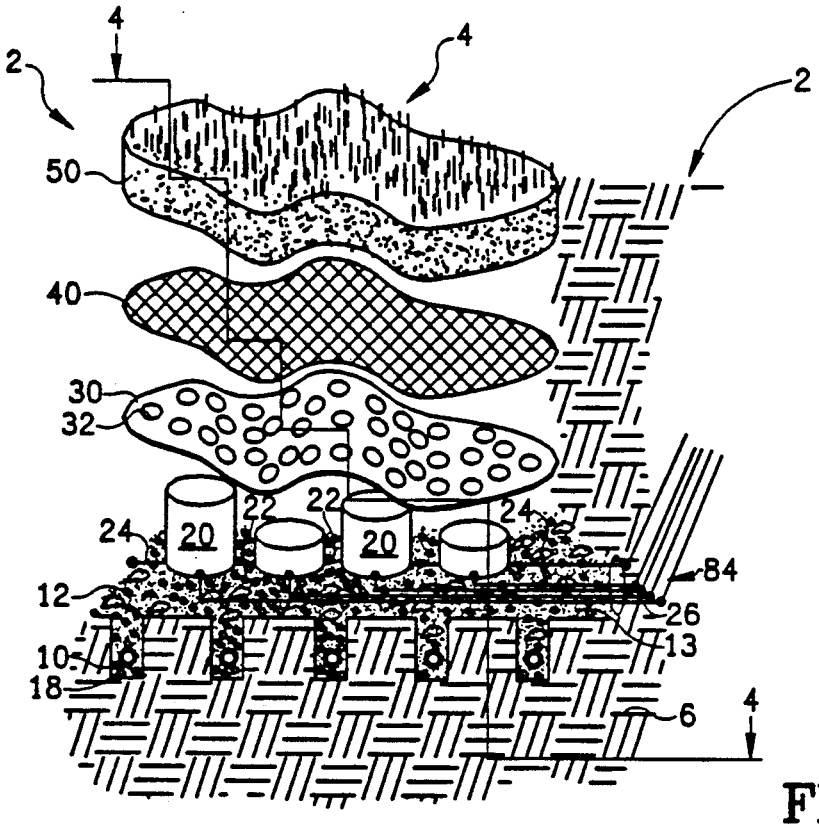
FIG. 3 is a partially exploded perspective view of the ground surface contour modifying apparatus of FIG. 2 showing the apparatus in a second actuated state.

Referring now to FIG. 3, hydraulic elements 20 are arranged in strings connected together by cable connector elements 22. Extending from the ends of each string of hydraulic elements 20 is an elongated flexible connector 24 which can be pulled to remove each string from defined area 4 for repair and/or replacement of hydraulic elements 20. If desirable, hydraulic elements 20 could be mounted on or between track or slide means represented in FIG. 4 by rails 25, to aid in the removal and insertion thereof in defined area 4. As an alternative, connectors 24 could extend from one end of each string of hydraulic elements with the connector cable at the other end wrapped around a pulley. In this way, hydraulic elements 20 could be removed from or reinserted into their allotted spaces by pulling a connector 24 from one position.

Each of hydraulic elements 20 are also each connected to a respective elongated conduit 26 (FIG. 3) which provides a source of hydraulic fluid, such as water or other suitable fluid, to the hydraulic elements. Positioned over the hydraulic elements is a relatively stiff but flexible support sheet structure 30 which may have a plurality of drainage holes 32 formed therein. The support sheet may be advantageously formed from a high density hardened plastic, as well as other materials having the desired stiffness and flexibility. One suitable material for support sheet 30 is polyvinylchloride or PVC.

Positioned on top of support sheet 30 is filter sheet 40 which filters out undesirable soil matter which should preferably be maintained above the support sheet 30 and the hydraulic elements. Filter sheet 40 may be a geotextile material or equivalent, or a layer of sand of about a two-inch thickness of sand and somewhat coarser than the sand/soil mix above.

On top of filter sheet 40 is conventional sand/soil mix 50 which provides a support medium for a grass surface 60 thereon. Conventionally, sand/soil mix is about 12 inches in thickness.

Hydraulic elements 20 are connected by hydraulic lines 26 to remote hydraulic injection apparatus 70 through a plurality of hydraulic connector lines 80. Hydraulic injection apparatus 70 includes a plurality of valves 90 corresponding to each hydraulic line 80. Valves 90 may be connected to a conventional watering system which advantageously serves as a source of hydraulic fluid.

Turning now to FIG. 2, hydraulic elements 20 are independently and selectively actuable through independent hydraulic lines 26, 80 and the valves 90. As may be seen from FIG. 3, a plethora of distinct ground surface configurations may be achieved by selective actuation of one or more of the hydraulic elements. In this manner, the ground surface and contour may be closely controlled and adjusted.

Figure 4:
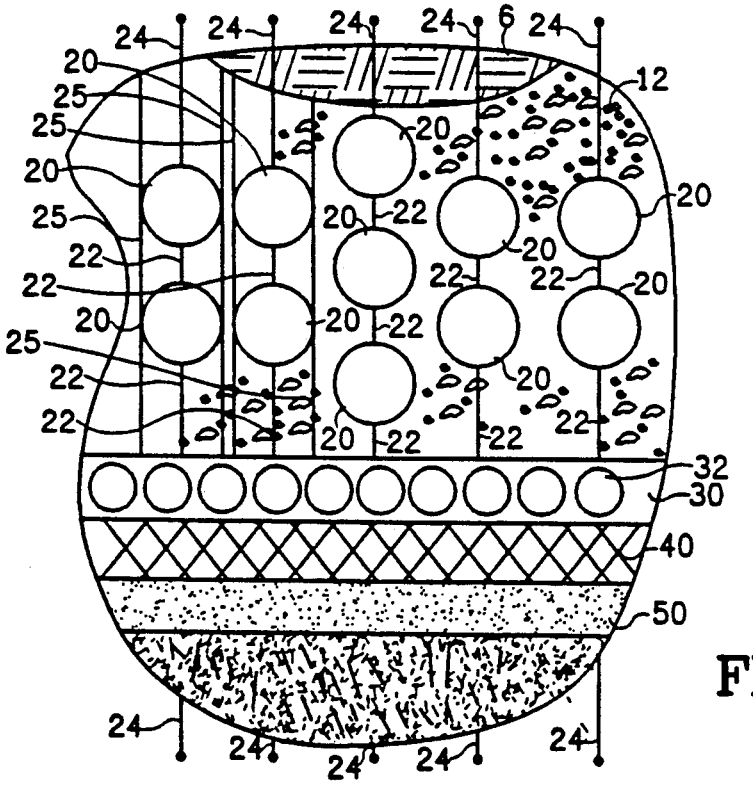
FIG. 4 is an upper plan view of the ground surface contour modifying apparatus of FIGS. 2 and 3 with successive sections of the defined area of ground broken away for clarity.
Figure 5:
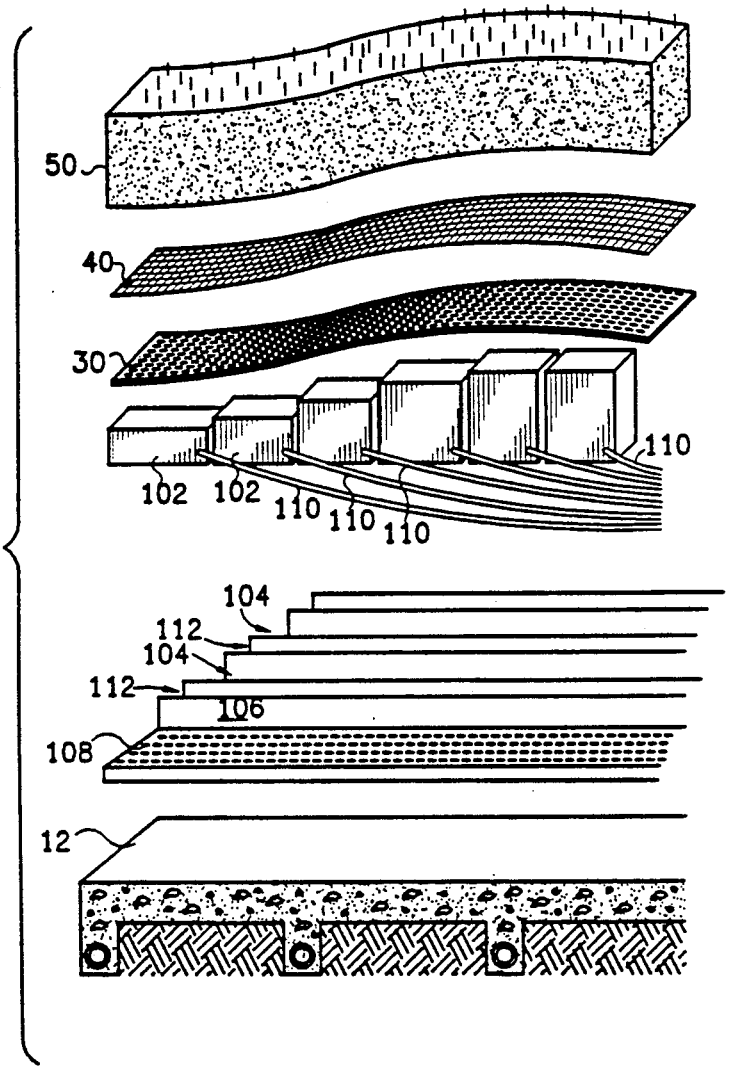
FIG. 5 is a partially exploded perspective view of an alternative embodiment of the ground surface contouring mechanism of the invention.
Figure 6:
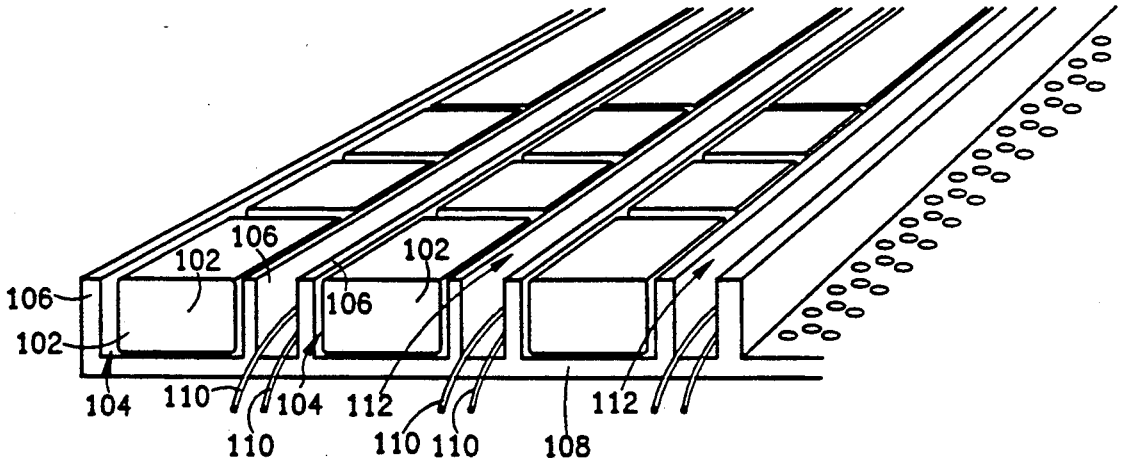
FIG. 6 is a partial end view of the hydraulic contour varying structure of FIG. 5.

A somewhat different arrangement of hydraulic elements or bladders 102 is shown in FIG. 5. Above the bladders is rigid but somewhat bendable plastic, perforated sheet 30, the same as shown in FIGS. 2–4. Similarly, geotextile filter sheet 40 resides above sheet 30, topped by sand/soil mix and grass surface 50. The bladders are positioned in grooves 104 defined by webs 106 projecting upwardly from the top surface of perforated rigid plastic support base 108. Base 108 rests on the surface of drainage bed 12.

Each bladder 102 is connected to a source of pressurized hydraulic fluid, such as apparatus 70 in FIG. 2, by means of tubing 110. The expansion or relaxation of the bladders is individually controllable, as discussed above. By placing the bladders in grooves 104 in support base 108 they are easily removed and reinserted. They may be interconnected by means of cables as previously discussed. Perforated channels 112 are formed between grooves 104 and provide for the downward transmission of drainage water as well as space for tubes 110 as may be used to reach downline bladders in permanent installations. By way of example, webs 106 may be four inches high, grooves 104 may be 12 inches wide, bladders 102 may be 18 inches long and channels 112 may be two inches wide. The bladders are thus confined fully when in their unexpanded condition and controlled when expanded by adding pressurized hydraulic fluid.

It is evident from the above description that all or any portion of defined area or green 4 may have the contouring apparatus of the invention positioned beneath it. Substantial changes can be made to the surface contours with only a few inches of vertical movement of selective hydraulic elements.

Thus, a ground surface contour modifying apparatus and method has been described. In view of the above description, it is likely that modifications and improvements will occur to those skilled in the art which are within the scope of the inventive concepts herein. It is understood, therefore, that the invention is not to be limited except in accordance with the spirit and scope of the appended claims.

What is claimed is:

1. A method for changing contour of the surface of the ground comprising the steps of:

placing a relatively stiff but somewhat flexible support sheet beneath the surface of the ground;

placing a plurality of hydraulic elements beneath the support sheet; and connecting means to independently deliver fluid to and remove fluid from each of the hydraulic elements, wherein the support sheet selectively rises and subsides, thereby changing the contour of the ground surface.

2. The method recited in claim 1, and comprising the further step of arranging the hydraulic elements in a plurality of independent strings of physically interconnected hydraulic elements.

3. The method recited in claim 2, and comprising the further step of applying elongated flexible means to each end of each such string to remove and replace such string.

4. The method recited in claim 1, wherein the support sheet is a high density hard plastic.

5. The method recited in claim 1, wherein the support sheet is perforated.

6. The method recited in claim 1, and comprising the further step of placing a flexible sheet of filter material between the support sheet and the ground thereabove.

7. The method recited in claim 1, wherein the hydraulic elements are flexible, non-corrosive bladders.

8. The method recited in claim 1, wherein each of the hydraulic elements is a stainless steel cylinder and piston arrangement.

9. The method recited in claim 1, and comprising the further steps of:

placing a stiff support base sheet beneath the hydraulic elements, the base sheet being formed with a plurality of top surface parallel grooves;

placing some of the hydraulic elements in the grooves; and applying elongated flexible means to each of the hydraulic elements in one of the grooves to connect them together to form a string to facilitate removal and replacement of the hydraulic elements in the string.

10. The method recited in claim 9, wherein the base sheet is perforated.

11. The method recited in claim 9, wherein the base sheet is formed with upstanding webs to form the parallel grooves in which the hydraulic elements reside.

12. The method recited in claim 11, wherein the upstanding webs are positioned to form slots between the grooves to receive tubes comprising the fluid connecting means.

13. A method for building a defined area of ground with means for changing the surface contour thereof, said method comprising the steps of:

preparing the defined area with compacted subsoil below the ground surface;

adding a bed of gravel above the subsoil;

placing a plurality of hydraulic elements on the gravel bed;

connecting elongated conduit means to each said hydraulic elements placing a relatively stiff support sheet on top of the hydraulic elements;

completing the defined area by placing growing plant soil material atop the support sheet; and connecting the conduit means to means for selectively, independently delivering fluid to and removing fluid from each of said hydraulic elements, whereby the support sheet is enabled to selectively rise and subside, thereby changing the contour of the ground surface.

14. The method recited in claim 13, and comprising the further step of placing a filter means on top of the support sheet.

15. The method recited in claim 13, and comprising the further step of placing a stiff support base sheet on the gravel bed and the placing the hydraulic elements on the base sheet.

16. The method recited in claim 14, and comprising the further step of placing a stiff support base sheet on the gravel bed and the placing the hydraulic elements on the base sheet.

17. The method recited in claim 15, and comprising the further steps of:

forming a plurality of parallel grooves on the top surface of the base sheet;

placing some of the hydraulic elements in the grooves; and applying elongated flexible means to each of the hydraulic elements in one of the grooves to connect them together to form a string to facilitate removal and replacement of the hydraulic elements in the string.

18. The method recited in claim 13, wherein the support sheet is a high density hard plastic.

19. The method recited in claim 15, wherein the base sheet is a high density hard plastic.

20. The method recited in claim 13, wherein the hydraulic elements are flexible, non-corrosive bladders.

21. The method recited in claim 13, wherein the hydraulic elements are a stainless steel piston and cylinder arrangement.

22. Apparatus for changing the contour of the surface of the ground, said apparatus comprising:

a relatively stiff but somewhat flexible support sheet beneath the surface of the ground;

a plurality of hydraulic elements located beneath said support sheet; and means connected to each of said hydraulic elements to selectively deliver fluid to and remove fluid from said hydraulic elements, thereby selectively raising and lowering the ground surface and causing the contours thereof to change.

23. The apparatus recited in claim 22, and further comprising elongated flexible means interconnecting some of said hydraulic elements together in at least one string of hydraulic elements.

24. The apparatus recited in claim 23, and further comprising elongated flexible means connected to each end of each said string to remove and replace such string of hydraulic elements.

25. The apparatus recited in claim 22, wherein said support sheet is a high density hard plastic.

26. The apparatus recited in claim 22, wherein said support sheet is perforated.

27. The apparatus recited in claim 22, and further comprising a sheet of filter material between said support sheet and the ground thereabove.

28. The apparatus recited in claim 22, and further comprising a rigid support base sheet beneath said hydraulic elements.

29. The apparatus recited in claim 28, wherein said base sheet is formed with a plurality of parallel grooves on the top surface thereof, some of said hydraulic elements being aligned in said grooves.

30. The apparatus recited in claim 29, wherein said grooves are formed by upstanding elongated web elements projecting upwardly from said top surface of said base sheet.

31. The apparatus recited in claim 29, and further comprising elongated flexible means interconnecting said hydraulic elements in each said groove to form at least one string of hydraulic elements.

32. Apparatus for building a defined area of ground on an equivalent area of compacted subsoil below the ground level with means for changing the surface contour of the ground, said apparatus comprising:

a bed of gravel above the subsoil;

a plurality of hydraulic elements positioned on top of said gravel bed;

a relatively stiff but somewhat bendable support sheet on top of said hydraulic elements;

a layer of growing plant soil material on top of said support sheet;

elongated conduit means individually connected to each said hydraulic element, each said conduit means being adapted to be connected to a source of pressurized fluid; and means to selectively deliver fluid to and drain fluid from each said hydraulic element, to cause selected areas of said support sheet to rise and subside and thereby change the contour of the ground.

33. The apparatus recited in claim 32, and further comprising a sheet of filter material located between said support sheet and said layer of soil material.

34. The apparatus recited in claim 32, and further comprising a rigid support base sheet between said gravel bed and said hydraulic elements.

35. The apparatus recited in claim 34, wherein said base sheet is formed with a plurality of parallel grooves on the top surface thereof, some of said hydraulic elements being aligned in said grooves.

36. The apparatus recited in claim 35, wherein said grooves are formed by upstanding elongated web elements projecting upwardly from said top surface of said base sheet.

37. The apparatus recited in claim 35, and further comprising elongated flexible means interconnecting said hydraulic elements in each said groove to form at least one string of hydraulic elements.

38. The apparatus recited in claim 32, and further comprising elongated flexible means interconnecting some of said hydraulic elements together in at least one string of hydraulic elements.

39. The apparatus recited in claim 38, and further comprising elongated flexible means connected to each end of each said string to remove and replace such string of hydraulic elements.

* * * * *